US010126044B2

(12) United States Patent
Laible

(10) Patent No.: US 10,126,044 B2
(45) Date of Patent: Nov. 13, 2018

(54) REFRIGERATION APPLIANCE WITH A FLUID RESERVOIR

(71) Applicant: BSH HAUSGERAETE GMBH, Munich (DE)

(72) Inventor: Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/328,102

(22) PCT Filed: Jul. 20, 2015

(86) PCT No.: PCT/EP2015/066557
§ 371 (c)(1),
(2) Date: Jan. 23, 2017

(87) PCT Pub. No.: WO2016/012402
PCT Pub. Date: Jan. 28, 2016

(65) Prior Publication Data

US 2017/0211873 A1 Jul. 27, 2017

(30) Foreign Application Priority Data

Jul. 23, 2014 (DE) ..... 10 2014 214 322

(51) Int. Cl.
*F25D 23/12* (2006.01)
*F25D 17/02* (2006.01)
*F25D 23/06* (2006.01)

(52) U.S. Cl.
CPC ..... *F25D 23/126* (2013.01); *F25D 17/02* (2013.01); *F25D 23/068* (2013.01); *F25D 2323/122* (2013.01)

(58) Field of Classification Search
CPC ..... F25D 23/126; F25D 17/02; F25D 23/068; F25D 2323/122; F25D 31/002; F25D 3/10; F25D 3/005; F25D 3/105
See application file for complete search history.

(56) References Cited

U.S. PATENT DOCUMENTS

| | | | | |
|---|---|---|---|---|
| 2,709,343 A | | 5/1955 | Muffly | |
| 3,908,394 A | | 9/1975 | Jacobus | |
| 4,866,949 A | * | 9/1989 | Rudick | B67D 1/0061 62/119 |
| 9,038,401 B2 | | 5/2015 | Johansson et al. | |
| 2008/0010999 A1 | | 1/2008 | Sonnenrein | |

(Continued)

FOREIGN PATENT DOCUMENTS

| | | |
|---|---|---|
| DE | 102005014742 A1 | 4/2006 |
| DE | 102006052445 A1 | 5/2008 |
| WO | 2010034330 A1 | 4/2010 |

*Primary Examiner* — Emmanuel Duke
(74) *Attorney, Agent, or Firm* — Laurence A. Greenberg; Werner H. Stemer; Ralph E. Locher

(57) ABSTRACT

A refrigeration appliance, in particular a household refrigeration appliance, includes a heat-insulating wall which delimits a cooled storage chamber, a reservoir embedded or let in the wall and a conduit for a heat transfer fluid. Part of the conduit forms a first heat exchanger which is disposed in thermal contact with the reservoir. A shut-off element can be switched between a position allowing circulation of the heat transfer fluid and a position blocking circulation.

10 Claims, 2 Drawing Sheets

(56) References Cited

U.S. PATENT DOCUMENTS

| | | | | |
|---|---|---|---|---|
| 2009/0044560 | A1* | 2/2009 | Buchstab | F25D 17/062 62/389 |
| 2009/0193834 | A1* | 8/2009 | Buchstab | F25D 23/126 62/389 |
| 2009/0260371 | A1 | 10/2009 | Kuehl et al. | |
| 2010/0031691 | A1* | 2/2010 | Buchstab | F25C 5/22 62/389 |

* cited by examiner

REFRIGERATION APPLIANCE WITH A FLUID RESERVOIR

BACKGROUND OF THE INVENTION

Field of the Invention

The present invention relates to a refrigeration appliance, in particular a domestic refrigeration appliance, with a heat-insulating wall which delimits a cooled storage chamber and a reservoir let into the wall. Such reservoirs are widely used to supply cold water dispensers in domestic refrigeration appliances.

When such a reservoir is filled with water, its temperature cannot drop below 0° C., on the one hand because the expansion associated with the water freezing may damage the reservoir and/or compress an insulating material layer adjoining the reservoir, thereby having an adverse effect on its heat insulating capacity, and on the other hand because cold water can no longer be drawn off if the contents of the reservoir have frozen. Therefore if the storage chamber, in the wall of which the reservoir is arranged, is designed for operation at temperatures below 0° C., suitable measures must be taken to reliably prevent the reservoir freezing.

Known from DE 10 2006 052 445 A1 is a refrigeration appliance with a water reservoir integrated in the rear wall of a dispenser recess, wherein air-conducting conduits are formed on one face of the reservoir, communicating with the storage chamber by way of a passage through the insulating material layer of the wall. These conduits function in the manner of a heat exchanger to cool the reservoir, using the air from the storage chamber as the heat transfer medium fluid. The low heat capacity of the air on the one hand means that a fan is required to ensure adequate air circulation for cooling the reservoir in normal operating conditions. On the other hand, to allow said air to circulate quietly at low speed, the cross section of the conduits must be large and the lack of space means that the conduits are short. The combination of short conduits and large cross section means that the air circulates through the heat exchanger even when the fan is not operating.

In order to ensure that this does not result in the contents of the reservoir freezing when the setpoint temperature of the storage compartment is low and the external temperature is also low, an electric heating unit is also arranged on the reservoir. However its operation requires additional energy and, as the heat released by the heating unit ultimately heats up the storage chamber, its operation also results in longer compressor operating times. The heating unit therefore significantly impairs the energy efficiency of the refrigeration appliance.

SUMMARY OF THE INVENTION

It is the object of the invention to specify a refrigeration appliance with a reservoir let into the heat-insulating wall, wherein excessive cooling of the reservoir can be avoided without using a heating unit.

The object is achieved in that in a refrigeration appliance, in particular a domestic refrigeration appliance, with a heat-insulating wall which delimits a cooled storage chamber, a reservoir let into the wall and a conduit for a heat transfer medium fluid, part of which forms a first heat exchanger arranged in thermal contact with the reservoir, a shut-off element is provided, which can be switched between a position that allows circulation of the heat transfer medium fluid in the conduit and a position that blocks circulation.

The heat transfer medium fluid is preferably a liquid, as with a small conduit cross section and low flow speed this is able to transfer more heat energy than a gas. The heat exchanger therefore takes up much less space in a refrigeration appliance than a conventional heat exchanger operating with air as the heat transfer medium, thereby increasing the useful volume of the refrigeration appliance.

The first heat exchanger is preferably arranged on a face of the reservoir facing the storage chamber. This means that it is shielded from ambient heat flowing through the reservoir itself, thereby avoiding unnecessary heat input into the heat transfer medium fluid.

If the heat transfer medium fluid is a liquid, it cannot be sucked directly out of the storage chamber and released back into it again. The conduit is therefore preferably a closed circuit, a second part of which forms a second heat exchanger arranged in thermal contact with the storage chamber.

The second heat exchanger is preferably arranged on an inner face of the heat-insulating wall. In particular it can be arranged between an inner skin and an insulating material layer of the heat-insulating wall in the manner of a cold wall evaporator.

Adhesion of the second heat exchanger to the inner skin favors the exchange of heat with the storage chamber.

If the second heat exchanger is arranged above the first heat exchanger, convection, which is brought about by the cooling of the heat transfer medium fluid in the second heat exchanger, can encourage the transfer of heat in the circuit, without additional drive energy having to be expended for the purpose.

In order to control the circulation of the heat transfer medium fluid, a pump can also be arranged in the closed circuit.

Such a pump can also expediently serve as a shut-off unit for preventing circulation. Pumps in which the driven elements fill the free cross section of the circuit completely, such as gear wheel pumps or rotary vane pumps, are particularly suitable for this, the cross section of the circuit being blocked and circulation therefore being prevented when the movable elements stop.

Alternatively a controlled valve can also serve as the shut-off unit.

A control signal for such a valve and/or for the pump can be supplied in particular by a thermostat regulator.

If the storage compartment can be cooled to a setpoint temperature below the freezing point of the heat transfer medium fluid, the shut-off unit can also be formed by at least one segment of the second heat exchanger, which can be closed off by freezing heat transfer medium fluid. Because the heat transfer medium fluid blocks this closable segment when the temperature is too low, excessive cooling of the reservoir, which could result in its contents freezing, can also be prevented.

In one alternative embodiment the expansion of the water during freezing can be utilized in that the shut-off unit comprises a water-filled expandable chamber, the volume expansion of which at least narrows the cross section of the conduit during freezing.

BRIEF DESCRIPTION OF THE SEVERAL VIEWS OF THE DRAWING

Further features and advantages of the invention will emerge from the description of exemplary embodiments which follows with reference to the accompanying figures, in which.

DESCRIPTION OF THE INVENTION

Figure 1:
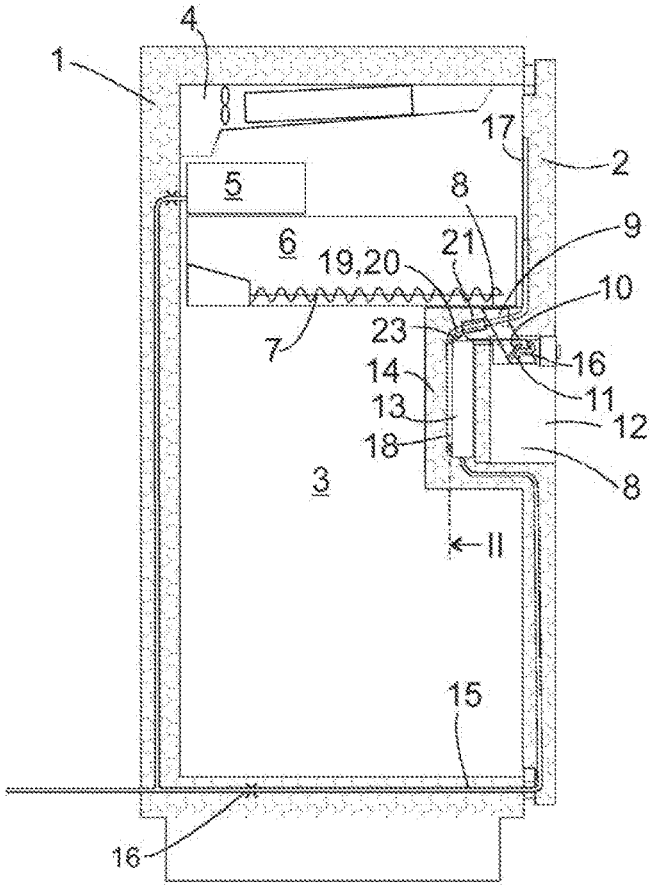
FIG. 1 shows a schematic section through an inventive refrigeration appliance.

The refrigeration appliance shown in a schematic section in FIG. 1 has a heat-insulating body 1 and a door 2, which delimit an interior. The interior is divided into a storage chamber 3, in this instance a freezer compartment, and an evaporator chamber 4, in which an evaporator and a fan for circulating air between evaporator chamber 4 and storage chamber 3 are housed.

An ice maker 5 is arranged directly below the evaporator chamber 4 in the storage chamber 3 so that it can be supplied directly with cold air from the evaporator chamber 4. Positioned below the ice maker 5 is a collector 6, which catches the ice cubes produced by the ice maker 5. A spiral conveyor 7 at the base of the collector 6 serves to convey ice cubes to an outlet 8 at an end of the collector 6 close to the door.

A recess 12 is formed in a central region of the door 2, in which a user can position a container in order to dispense ice from the collector 6 therein, without opening the door 2. An upper wall of the recess 12 is located below the outlet 8 of the collector 6. A tubular or funnel-type passage, also referred to as the ice chute 9, extends through this wall. Arranged at the lower end of the ice chute 9 is a movable flap 10, which blocks the ice chute 9 in an airtight manner in the closed position so that warm air from the recess 12 cannot pass through the ice chute 9 into the storage chamber 3.

Arranged on the outer face of the flap 10 is a water outlet 11, by way of which a container positioned in the recess 12 can also be filled with cold water from a reservoir 13. The reservoir 13 is let into a wall of the recess 12, in this instance a rear wall, and is separated from both the recess 12 and the storage chamber 3 by a heat-insulating layer 14, so that during stationary operation the temperature in the reservoir 13 is between the temperature of the storage chamber 3 and that of the environment.

The reservoir 13 is connected to a domestic water supply line (not shown) by way of a conduit 15 that extends through the door 2 and walls of the body 1. When water is drawn from the reservoir 13 into a container in the recess 12, a solenoid valve 16 in the conduit is opened so that cold water from the reservoir 13 is displaced by relatively warm water flowing in behind it from the domestic water supply line. If this water could only output its heat to the storage chamber 3 by way of the heat-insulating layer 14, it would be a long time before it was possible to draw off cold water again. To avoid this, it is necessary to be able to intensify the exchange of heat between the reservoir 13 and the storage chamber 3. However it must also be possible, if necessary, to stop said flow of heat again in order to prevent the water in the reservoir 13 freezing.

To this end two heat exchangers 17, 18 are connected to one another in a heat transfer medium circuit 22 in the door 2, with a heat transfer medium liquid circulating therein. One of these, also referred to here as the cold heat exchanger 17, is arranged on an inner face of the door 2 in close thermal contact with the storage chamber 3. It is preferably concealed behind an inner skin of the door 2, which is generally made of deep-drawn plastic. To allow a fast exchange of heat, the cold heat exchanger 17 can have a conduit with a flattened cross section resting against the inner skin; alternatively or additionally an adhesive layer in a space delimited by the outer skin and a rounded section of the pipe can enlarge the surface on which an intensive exchange of heat is possible. The freezing point of the heat transfer medium liquid is below the lowest setpoint temperature that can be set for the storage chamber 3, so the heat transfer medium liquid in the cold heat exchanger 17 cannot freeze. The heat transfer medium liquid can be for example an antifreeze solution for use in motor vehicle cooling systems.

The other, warm heat exchanger 18 is in contact with the reservoir 13. The warm heat exchanger 18 here is located on a face of the reservoir 13 facing the storage chamber 3 in order to be insulated from the environment by the reservoir 13 itself and thus to avoid unnecessary heat absorption from the environment.

Figure 2:
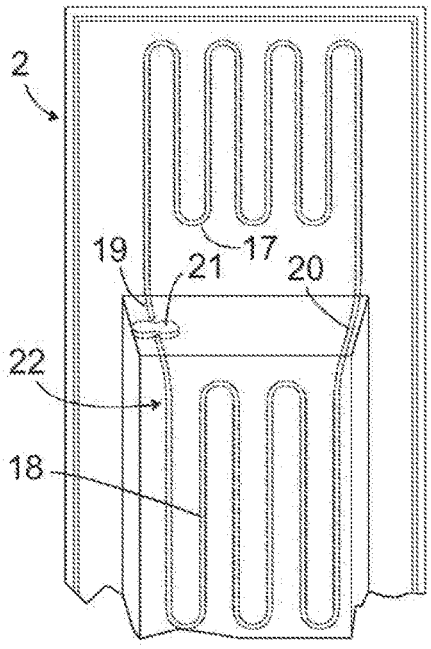
FIG. 2 shows the course of a heat transfer medium conduit on the inner face of the door of the refrigeration appliance according to a first embodiment of the invention.

FIG. 2 shows an internal view of the door 2 according to a first embodiment of the invention. The heat exchangers 17, 18 and conduits 19, 20 connecting them are shown with broken lines in FIG. 2 as they are not visible in reality. In fact the cold heat exchanger 17 is enclosed above the recess 12 between the inner door skin covering the entire door inner surface and the heat-insulating layer 14 and part of the heat-insulating layer 14 is also located between the warm heat exchanger 18 and the inner skin.

The heat exchangers 17, 18 and conduits 19, 20 can be formed as cohesive single parts from a pipe or hose made of metal or plastic, extending in vertical meanders as shown in FIG. 2. The two ends of the pipe or hose are connected to the input and output of a pump 21, to form a closed circuit. The pump 21 is shown here in the conduit 19 but could be in any position in the heat transfer medium circuit 22, even within one of the heat exchangers 17, 18.

The pump 21 is connected to a temperature sensor 23, which is arranged on an upper face of the reservoir 13. The temperature sensor 23 starts the pump 21 when a detected high temperature or temperature rise indicates that fresh water has flowed in from the domestic water supply line and switches the pump 21 off as soon as the detected temperature drops below a limit temperature of several degrees above 0° C.

The design of the pump 21 is such that it blocks the circulation of heat transfer medium liquid through the heat exchangers 17, 18 when switched off. The pump 21 used could therefore be a gear wheel pump.

If for example a rotary pump is used or generally a pump which does not block the heat transfer medium circuit 22 when stopped, a valve should be provided in the heat transfer medium circuit, which serves as a shut-off unit when the pump is switched off. This reliably prevents the reservoir 13 being cooled by way of the heat transfer medium circuit 22 if the temperature of the water in the reservoir 13 is close to 0° C.

Figure 3:
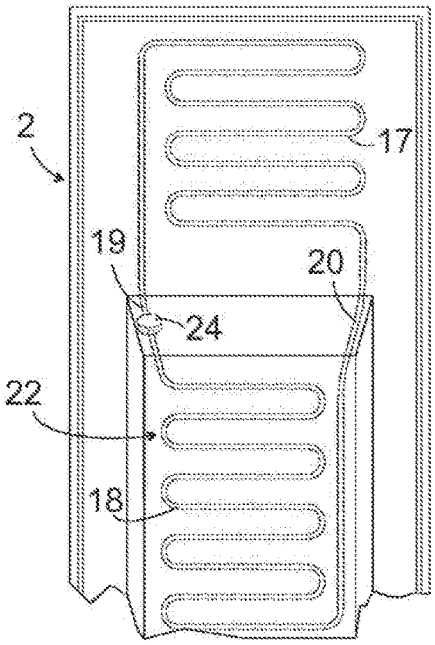
FIG. 3 shows the course of the heat transfer medium conduit according to a second embodiment in a representation similar to the one in FIG. 2.

In the embodiment in FIG. 3 the meanders of the heat exchangers 17, 18 are horizontal, the conduit 19 connecting upper ends of the heat exchangers 17, 18 directly and the conduit 20 connecting their lower ends directly. Such asymmetry favors a purely convection-driven circulation of the heat transfer medium liquid in the circuit 22. A valve 24 activated by way of a temperature sensor at the reservoir 13 operates as a shut-off unit here, preventing circulation of the heat transfer medium liquid when the temperature of the reservoir 13 is low. The valve 24 is shown in the conduit 19 again but it could be in any other position in the circuit 22.

Figure 4:
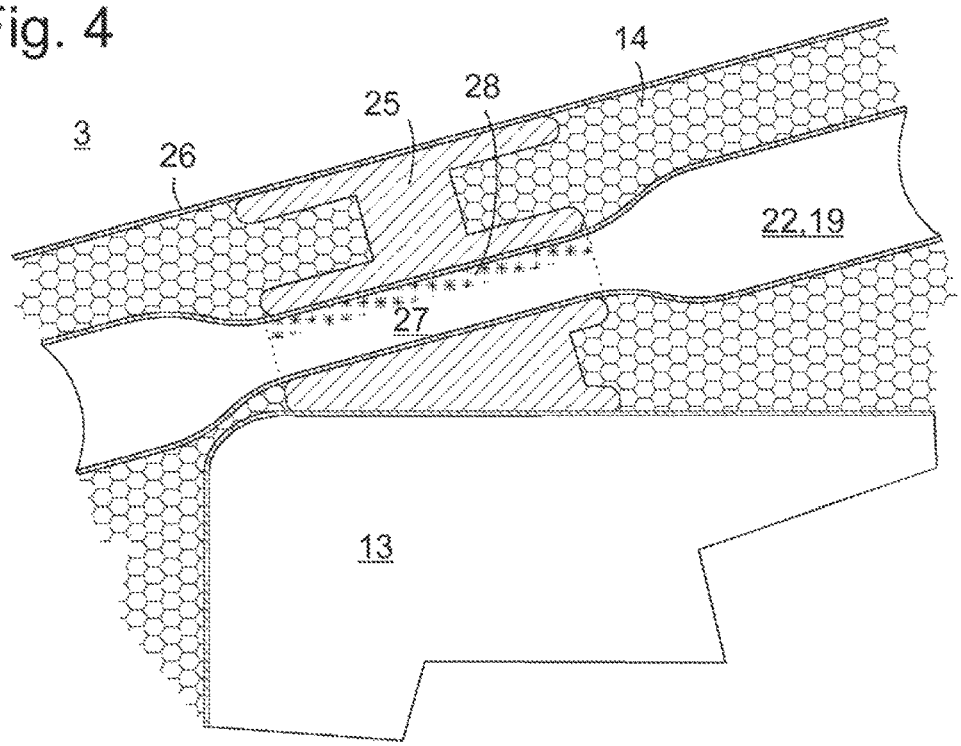
FIG. 4 shows an enlarged detail of the heat-insulating wall of the refrigeration appliance in cross section according to a third embodiment.

FIG. 4 shows a detail from the door 2, which separates the reservoir 13 from the storage chamber 3, according to a third embodiment of the invention. The freezing point of the heat transfer medium liquid in this embodiment is below 0° C. but above the temperature of the storage chamber 3 and therefore the cold heat exchanger 17 is separated from the storage chamber 3 by a thin layer of heat-insulating material here, preventing the heat transfer medium liquid freezing in the heat exchanger 17. A heat conducting body 25 is embedded in the heat-insulating layer 14, in this instance on the upper face of the recess 12, with one end making contact with the inner skin 26 of the door and the other end making contact with the upper face of the reservoir 13 and with a passage, through which the heat transfer medium circuit 22, again the conduit 19 here, passes. The cross section of the heat conducting body 25 is small in relation to the surface of the reservoir 13; therefore its influence on the temperature of the reservoir 13 is negligible. The passage forms a constriction 27 in the circuit 22. The surfaces of the heat conducting body 25 delimiting the constriction 27 assume a temperature between that of the storage chamber 3 and that of the reservoir 13. The freezing point of the heat transfer medium liquid circulating in the heat transfer medium circuit 22 is selected so that the surface of the heat conducting body 25 adjoining the constriction 27 is below this temperature when the temperature of the reservoir 13 is just above 0° C. The layer 28 of solidified heat transfer medium liquid, which forms in the constriction 27 here, also narrows the constriction 27. This reduces the flow speed of the heat transfer medium liquid which further favors the growth of the layer 28. Once it closes off the constriction 27, the transfer of heat between the heat exchangers 17, 18 also comes to a halt, without a temperature sensor being required. When water is drawn off and warm water from the domestic water supply line follows it, it collects initially in the upper part of the reservoir 13 and heats the heat conducting body 25 so that the layer 28 liquefies and the heat transfer resumes. A switch between an open and blocked state of the constriction 27 here is controlled directly by way of the temperatures of the storage chamber 3 and reservoir 13, without requiring the additional use of electronic control circuits.

Figure 5:
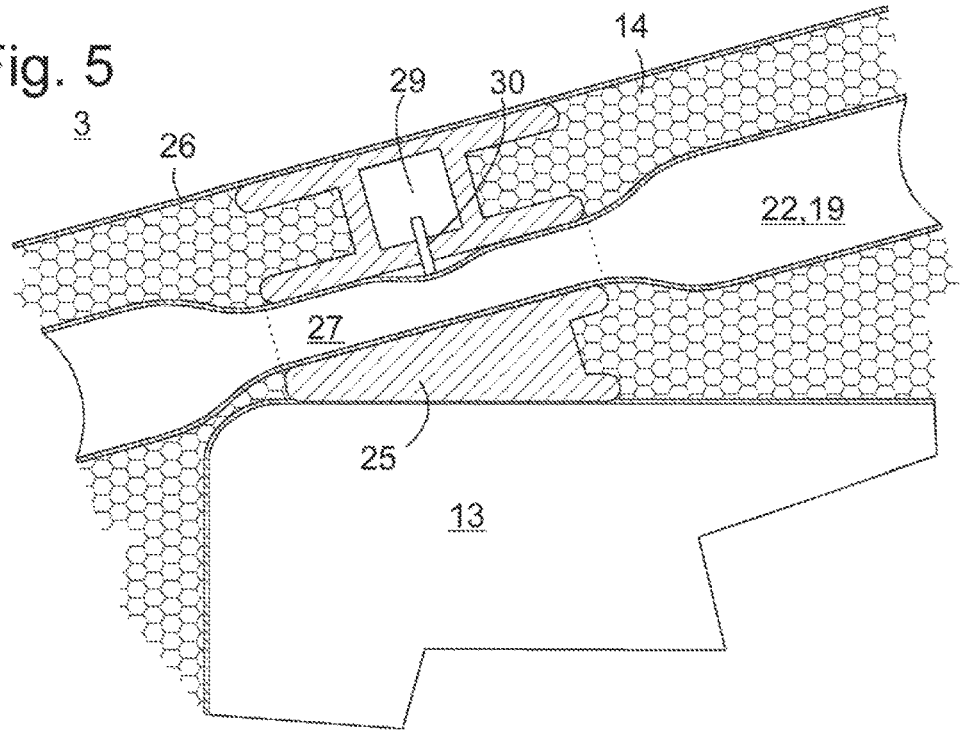
FIG. 5 shows a section similar to the one in FIG. 4 according to a fourth embodiment.

FIG. 5 shows a section similar to the one in FIG. 4 according to a further embodiment of the invention. Again a heat conducting body 25 is arranged between the inner skin 26 and the reservoir 13. On its face facing the storage chamber 3 the heat conducting body 25 contains a water-filled chamber 29 closed off with a movable piston 30. Before the reservoir 13 cools to 0° C., the contents of the chamber 29 freeze and drive the piston 30 into the constriction 27 so that circulation of the heat transfer medium liquid preferably comes to a complete halt, or is at least restricted significantly enough to prevent the reservoir 13 freezing.

REFERENCE CHARACTERS

1 Body
2 Door
3 Storage chamber
4 Evaporator chamber
5 Ice maker
6 Collector
7 Spiral conveyor
8 Outlet
9 Ice chute
10 Flap
11 Water outlet
12 Recess
13 Reservoir
14 Heat-insulating layer
15 Conduit
16 Solenoid valve
17 Heat exchanger
18 Heat exchanger
19 Conduit
20 Conduit
21 Pump
22 Heat transfer medium circuit
23 Temperature sensor
24 Valve
25 Heat conducting body
26 Inner skin
27 Constriction
28 Layer
29 Chamber
30 Piston

The invention claimed is:

1. A refrigeration appliance or domestic refrigeration appliance, comprising:

a heat-insulating wall delimiting a cooled storage chamber;

a reservoir embedded in said wall;

a conduit for a heat transfer fluid, said conduit being a closed heat transfer circuit, part of said conduit forming a first heat exchanger disposed in thermal contact with said reservoir, and said conduit having a second part forming a second heat exchanger disposed in thermal contact with said storage chamber; and a shut-off element to be switched between a position allowing circulation and a position blocking circulation of the heat transfer fluid in said conduit, said shut-off element including a water-filled expandable chamber.

2. The refrigeration appliance according to claim 1, wherein said heat transfer fluid is a liquid.

3. The refrigeration appliance according to claim 1, wherein said reservoir has a face facing said storage chamber, and said first heat exchanger is disposed on said face of said reservoir facing said storage chamber.

4. The refrigeration appliance according to claim 1, wherein said heat-insulating wall has an inner face, and said second heat exchanger is disposed on said inner face of said heat-insulating wall.

5. The refrigeration appliance according to claim 1, wherein said second heat exchanger is disposed above said first heat exchanger.

6. A refrigeration appliance or domestic refrigeration appliance, comprising:

a heat-insulating wall delimiting a cooled storage chamber, said heat-insulating wall having an inner skin and an insulating material layer;

a reservoir embedded in said wall;

a conduit for a heat transfer fluid, said conduit being a closed heat transfer circuit, part of said conduit forming a first heat exchanger disposed in thermal contact with said reservoir and said conduit having a second part forming a second heat exchanger disposed in thermal contact with said storage chamber, said second heat exchanger being disposed between said inner skin and said insulating material layer of said heat-insulating wall;

a shut-off element to be switched between a position allowing circulation and a position blocking circulation of the heat transfer fluid in said conduit.

7. The refrigeration appliance according to claim 6, which further comprises a pump disposed in said closed heat transfer circuit.

8. The refrigeration appliance according to claim 7, wherein said pump forms said shut-off element.

9. The refrigeration appliance according to claim 6, which further comprises a controlled valve forming said shut-off element.

10. A refrigeration appliance or domestic refrigeration appliance, comprising:

a heat-insulating wall delimiting a cooled storage chamber;

a reservoir embedded in said wall;

a conduit for a heat transfer fluid, said conduit being a closed heat transfer circuit, part of said conduit forming a first heat exchanger disposed in thermal contact with said reservoir, and said conduit having a second part forming a second heat exchanger disposed in thermal contact with said storage chamber; and a shut-off element to be switched between a position allowing circulation and a position blocking circulation of the heat transfer fluid in said conduit;

the heat transfer fluid having a freezing point, said storage compartment being configured for being cooled to a setpoint temperature below the freezing point of the heat transfer fluid, and said shut-off element being formed by at least one segment of said heat transfer circuit being closed off by freezing the heat transfer fluid.

* * * * *